US005351964A

United States Patent [19]

Kruger

[11] Patent Number: 5,351,964

[45] Date of Patent: Oct. 4, 1994

[54] GOLF BALL TEEING DEVICE

[75] Inventor: Robert D. Kruger, Henderson, Colo.

[73] Assignee: WorldWide Golf Resources, Inc., Denver, Colo.

[21] Appl. No.: 159,825

[22] Filed: Dec. 1, 1993

[51] Int. Cl.[5] ..... A63B 57/00

[52] U.S. Cl. ..... 273/201

[58] Field of Search ..... 273/33, 201, 202

[56] References Cited

U.S. PATENT DOCUMENTS

| | | | |
|---|---|---|---|
| 2,295,599 | 9/1942 | Mozel | 273/201 |
| 2,696,985 | 12/1954 | Hogeberg | 273/201 |
| 3,549,152 | 12/1970 | Gentiluomo | 273/201 |
| 3,778,067 | 12/1973 | Gentiluomo . | |
| 4,017,087 | 4/1977 | Bruno | 273/201 |
| 4,181,309 | 1/1980 | Atkinson et al. | 273/201 X |
| 4,194,648 | 3/1980 | Stanton . | |
| 4,198,054 | 4/1980 | Stone | 273/201 |
| 4,319,753 | 3/1982 | Mann | 273/201 |
| 4,355,811 | 10/1982 | Williams, Sr. | 273/201 |
| 4,575,092 | 3/1986 | Watson . | |
| 4,815,744 | 3/1989 | Diamandis . | |
| 5,052,688 | 10/1991 | Shiau | 273/201 X |
| 5,078,401 | 1/1992 | Fehrenbach et al. . | |
| 5,131,661 | 7/1992 | Jorgensen . | |

*Primary Examiner*—Vincent Millin
*Assistant Examiner*—Raleigh W. Chiu
*Attorney, Agent, or Firm*—H. Kenneth Johnston, II

[57] ABSTRACT

A golf ball teeing device for providing golf practice through a multi-elevation tee allowing both fairway and tee shots from the same practice tee. The device consists essentially of a ball teeing means having a tee capable of being raised from its lower most position in which it receives a golf ball to various elevated positions replicating various golf shots, and a ball delivery tube to provide balls one at a time to the tee when it is in its lower most position and a hopper for supplying golf balls to the delivery tube, a photoelectric sensor to determine that a ball has been received on to the tee and a ball receptacle restraint allowing the tee to be raised to a hitting elevation without another ball possibly jamming the device and a photoelectric sensor to determine that the ball has been dislodged from the tee requiring the tee to return to its lower most position to receive another golf ball to repeat the cycle and a controller means for sensing the input from the photoelectric sensors and providing a elevation adjustment and the power to raise and lower the tee.

9 Claims, 4 Drawing Sheets

GOLF BALL TEEING DEVICE

BACKGROUND OF THE INVENTION

The subject device relates to a golf swing practice device which includes a mechanism for automatically teeing golf balls into a typical position one might attain in actual play allowing an individual to practice various stokes without the necessity of having to individually tee each ball. The device further allows an individual to practice these strokes on real turf giving the individual a more realistic feel of the game.

Currently there are numerous golf swing practice devices on the market which enable a golfer to practice his or her stroke, which include practice ranges, and may be inside or outside. Some of the prior art includes automatic teeing devices which eliminates the golfer from having to perform the teeing function manually.

Many of the devices are cumbersome, expensive and do not provide the feel of real turf to the golfer. U.S. Pat. No. 5,131,661 is such a device wherein it is expensive to construct, maintain, is not readily portable, and has sophisticated electronics.

U.S. Pat. Nos. 4,194,648 and 4,575,092 are golf ball dispensers but do not provide the teeing system beneficial in practicing the tee and fairway shots.

U.S. Pat. No. 5,078,401 discloses a light responsive automatic golf tee having a hollow tee and a light sensitive cell placed at the base of the tee which causes the tee to be lowered when the ball is removed from the tee inadvertently such as a tap by the golfers club. The device requires a more elaborate tee mechanism because of the requirement of the tee to be hollow.

In U.S. Pat. No. 4,815,744 the teeing mechanism is required to be activated by the golfer after each ball has been hit and allows the teeing device to lower by gravity. The requirement to have to actuate a switch detracts from the practice that the golfer is working on to maintain a repeatable swing. Additionally, because the teeing device is allowed to free fall, i.e., gravity lowers the teeing device, the device may not lower to the lower most position to allow a new ball to be loaded onto the tee.

In U.S. Pat. No. 3,778,067 Gentiluomo shows a moveable tee which is enclosed in a tube which prevents the ball from rolling off the other side of the tee when leaving the ramp. The light detector is located inside the tee, which is hollow and contains a lens assembly inside, under the opening which is covered by the golf ball. The lens assembly sends light through a fiber-optic light guide to a photocell unit which is part of the control circuitry and the light guide is susceptible to breakage. Gentiluomo further shows a device which utilizes two stops which physically prevent the tee from moving past the lower position and the highest position with a clutch mechanism to prevent the motor from burning up when the tee comes against the stop. This system is cumbersome and may easily malfunction.

The majority of the devices require platforms of some nature having artificial surfaces which attempt to give the feel of a natural setting, although the within device may be used with a platform, it is constructed in a manner to allow the golfer to use the natural turf as he or she would encounter on a golf course.

The current device eliminates the above problems in that it is a relatively inexpensive device, is easily installed, and allows the golfer if desired, to have the feel of real turf when practicing his or her various tee and fairway shots. Although a driving range utilizing the device may use mats to eliminate having to move the device the home golfer may get extensive use without having to move the device to another location.

Accordingly, it is an object of this invention to provide an improved golf swing practice device of the type described which automatically tees up a golf ball after each shot, allows the golfer to select various tee elevations to simulate the various aspects of play that one might encounter during a round of golf.

Still another object of this invention is to provide an improved device of the type described which is particularly suited for use with natural turf which allows the golfer to have the feel as if he or she were actually playing on a course.

It is an object of the invention that because the device can be moved readily, the teeing device can be placed in different locations allowing the natural turf to rejuvenate itself.

It is further another object of the invention to be handicap friendly in that because the device does not utilize a platform, wheelchair bound individuals do not require a special ramp to get to the hitting area and therefor have access without the facility having to install special equipment to get onto the hitting surface.

It is another object of the invention to provide a unique sensing means for determining the loading of a golf ball on to the tee and when a golfer has dislodged the ball by hitting the ball.

Other objects of the invention will be apparent hereinafter from the specification and from the recital of the appended claims, particularly when read in conjunction with the accompany drawings.

SUMMARY OF THE INVENTION

The present invention comprises an automatic tee for repeatedly hitting golf balls without the need for manually replacing the ball on the tee after each shot. After the ball is hit from the tee of the present invention, the photoelectric sensor senses the movement of the tee and the tee lowers into the ground and reappears momentarily with a new ball ready to be hit.

The tee is powered by an electric motor driving a pinion gear up and down a rack which is mounted to the frame surrounding the tee. The tee is mounted on the tee platform opposite the motor and both move up and down the rack as a single unit.

Replacement balls are gravity fed onto the tee at its lower most position from the delivery tube.

The height to which the tee will rise is easily changed by moving the height adjustment switch which is triggered by a micro switch and allows the tee height to be adjusted in small increments. The height adjustment switch allows the motor to continue to move upward for varying times once the micro-switch has been activated, however, in the upper most position the microswitch immediately stops the motor resulting in the maximum rise in the tee. Once a golfer has hit the ball from the tee, the movement of the tee allows a photoelectric sensor which is located in the side walls of the upper portion of the ball cup to be activated and triggers the motor to start movement downward to the lower most position to receive another ball. When the motor drive housing reaches the lower most position, a micro-switch is activated stopping further downward movement of the tee platform. As the tee platform moves downward, the ball restraint which is located in the ball cup, moves downward and allows the next ball to enter the ball cup and onto the waiting tee and at the same time triggers a photoelectric sensor located in the lower portion of the ball cup causing the new ball to be raised on the tee and raises the ball restraint to move upward preventing another ball to enter the ball cup possible causing a jam and thus starting the process over again.

The photoelectric sensors in the upper part of the ball cup are aligned in such a manner that the when the tee is struck by the golfer, the movement of the tee allows the sensors to "see" each other thus actuating the drive mechanism to move the tee platform downward. The photoelectric sensors in the lower part of the ball cup are aligned so that when the ball entering the ball cup onto the tee, the beam between the sensors is broken actuating the drive mechanism to move the tee platform upward. When the last ball has been hit and the tee platform returns to the lower most position for another ball, the unit will remain in the lower most position until the system has been reloaded with balls in which case the process begins again.

DETAILED DESCRIPTION OF THE PREFERRED EMBODIMENTS

Figure 1:
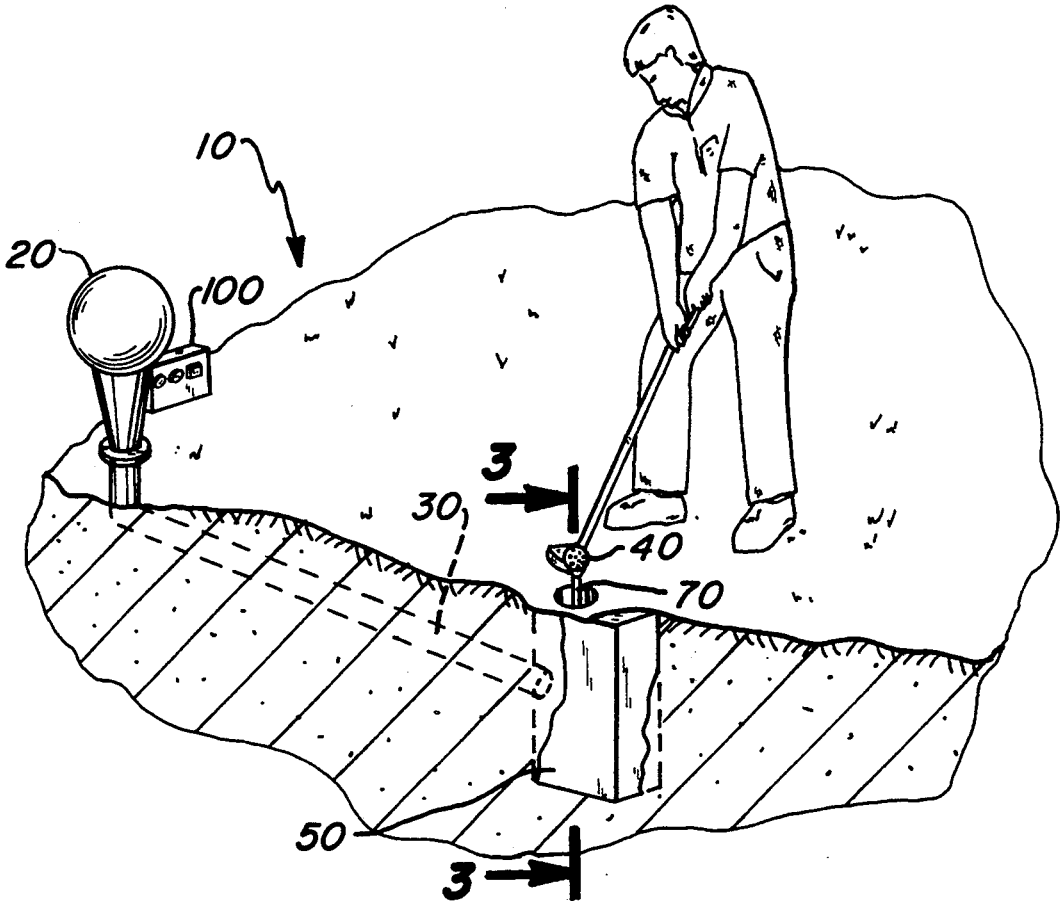
FIG. 1 is a perspective view of the golf practice device shown in place with a golfer in practice position.

Referring now to the drawings, FIG. 1 generally denotes the golf swing practice device 10 having a hopper 20 for storage and supply of golf balls, ball delivery tube 30 installed at an incline so that the golf balls 40 will feed by gravity to the ball tee means 50.

Figure 2:
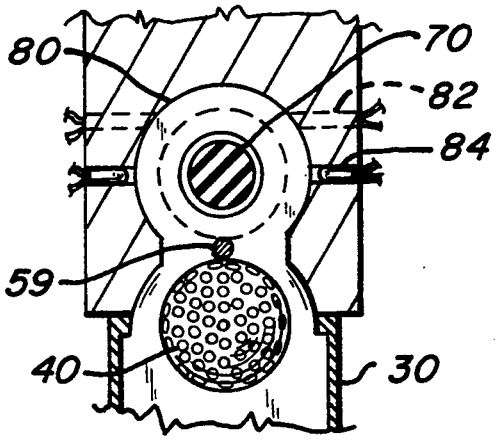
FIG. 2 is a cross-sectional view of the ball cup taken along the lines 2—2.
Figure 4:
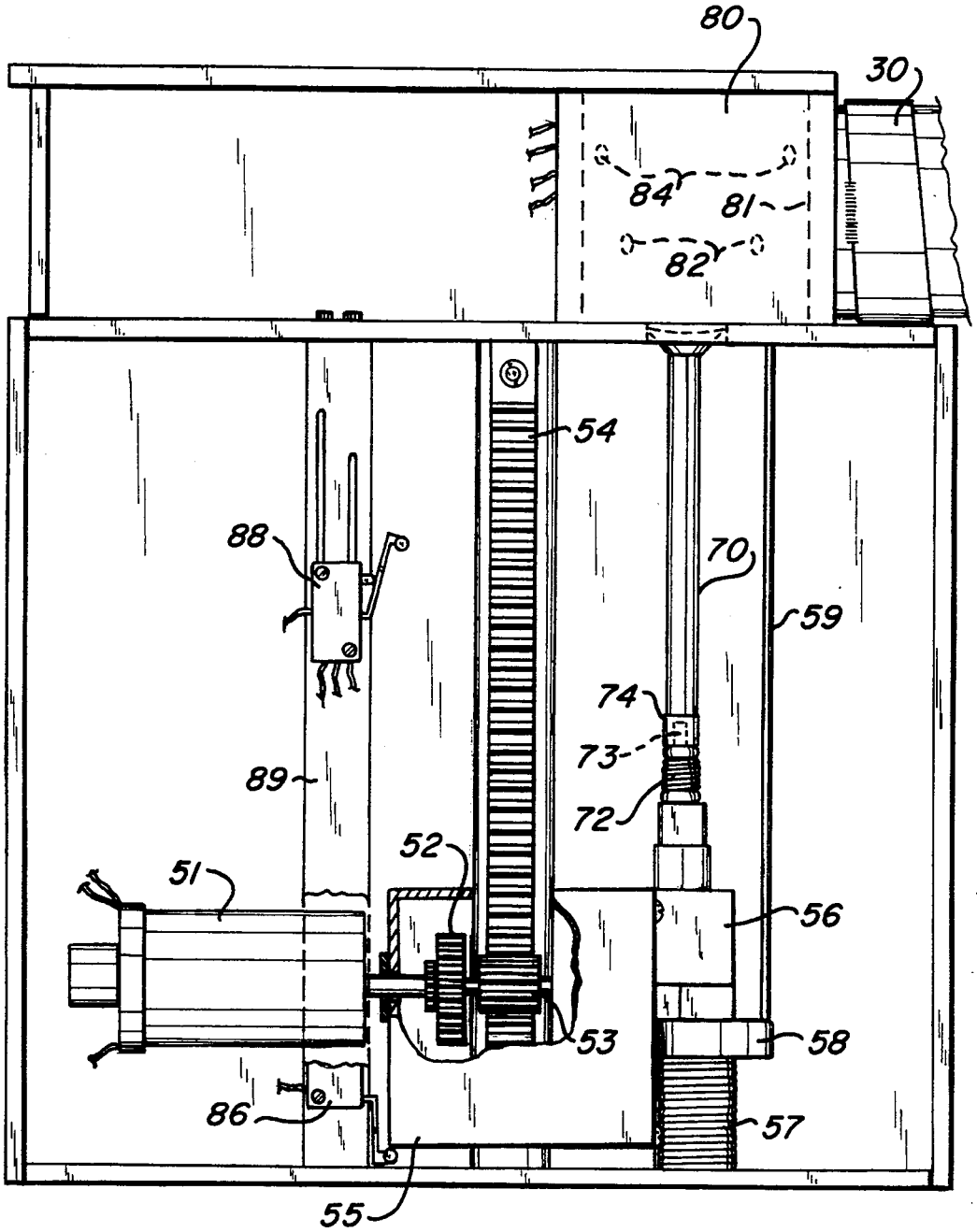
FIG. 4 is a schematic side view of the ball teeing means associated with the invention.

In operation a golf ball 40 enters into the ball cup 80 through ball inlet aperture 81 from ball delivery tube 30 and activates lower photoelectric sensor 82 as it is seated on removable flexible tee 70 as shown in FIGS. 2 and 4. Ball delivery tube 30 may be made of flexible tube to allow the movement of the ball tee means 50 without having to move the hopper 20.

Upon the activation of photoelectric sensor 82, motor 51 which is affixed to motor drive housing 55 is energized driving motor gear train 52 which in turn drives pinion gear 53 causing it to move vertically upward on rack 54. Tee platform 56 is affixed to motor drive housing 55 opposite motor 51 so that when motor 51 is energized, motor 51 and tee platform 56 move up and down rack 54 in unison. Removable flexible tee 70 is removably affixed to the threaded male connector 73 on tee platform 56 by threaded female connector 74. Removable flexible tee 70 is made of a material such as a urethane which provides weather resistance and durability through numerous strikes by a golf club. Tee spring 72 is attached to the tee platform 56 at one end and at the other end to the lower end of threaded male connector 73 and which is affixed to the threaded female connector 74 so that when the golfer strikes the golf ball 40 and removable flexible tee 70 there is sufficient movement of the removable flexible tee 70 to actuate upper photoelectric sensor 84. Tee spring 72 also provides the removable flexible tee 70 some additional movement without the removable flexible tee 70 having to do all the flexing and thus extending the potential life of the removable flexible tee 70.

When the motor drive housing 55 is moving downward, motor 51 is immediately stopped when motor drive housing 55 contacts lower position limit switch 86 affixed on the lower portion of support 89.

As shown in FIG. 4, when removable flexible tee 70 is in the lower most position, tee platform 56 is in contact with ball restraint platform 58 in its lower most position compressing ball restraint spring 57 and causing ball restraint 59 to be in its lower most position and allowing golf ball 40 to roll in to ball cup 80 as previously described. Ball receptacle restraint 59 also acts as a guide for tee platform 56 as it moves up and down. Also ball cup 80 has openings not shown to the exterior of the unit to allow moisture which might collect from rain or snow to drain out.

Figure 5:
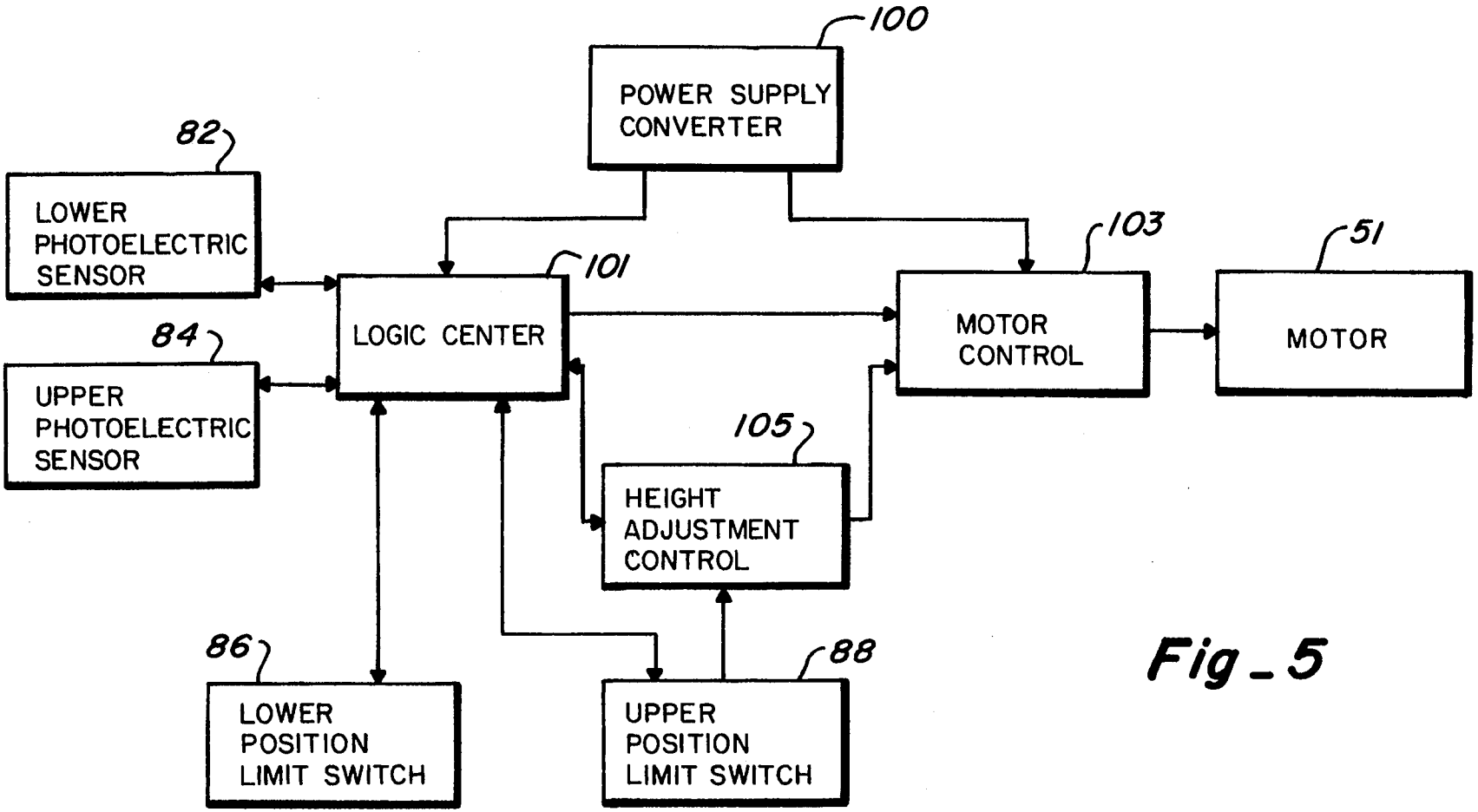
FIG. 5 is a block diagram of the electrical system of the invention.

Once golf ball 40 activates lower photoelectric sensor 82 a signal is detected at logic center 101 and causes motor control 103 to initiate motor 51 driving motor drive housing 55 and moving upward through the upward movement of pinion gear 53 on rack 54 moving removable flexible tee 70 and golf ball 40 upward to the hitting position. Depending on the setting of the height adjustment control 105, as motor drive housing 55 contacts upper position limit switch 88 affixed on the upper portion of support 89 motor control 103 determines the amount of time that motor 51 can continue to operate before stopping motor 51 setting the height of the removable flexible tee 70. The power for the golf swing practice device 10 is converted to from 110 volt to 12 volt by power supply converter 100 thus allowing out-of-doors usage without concern for potential shock from 110 volts as shown in FIG. 5.

Figure 3:
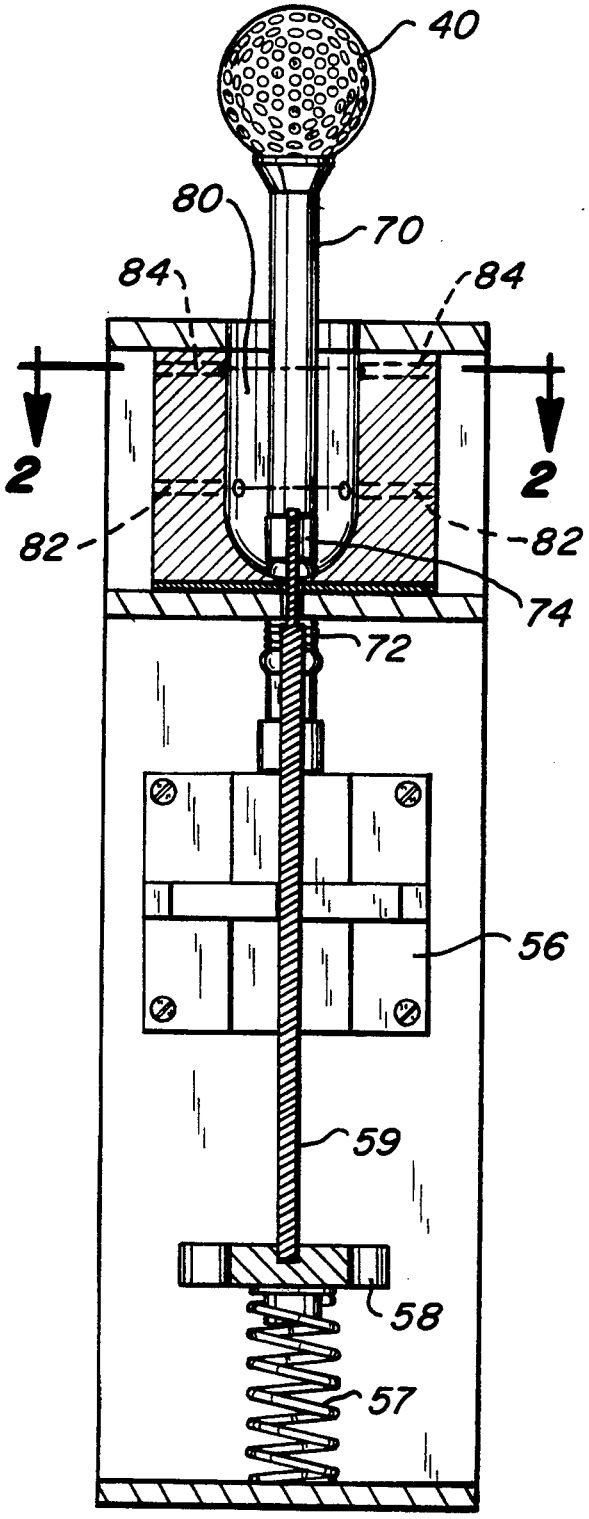
FIG. 3 is a cross-sectional view of the ball tee means taken along the lines 3—3.

As the removable flexible tee 70 moves upward, tee platform 56 moves upward removing the pressure on ball restraint platform 58 allowing it to be forced upward by ball restraint spring 57 and moving ball receptacle restraint 59 into place precluding golf ball 40 from rolling into ball cup 80 when the removable flexible tee 70 is in the up position as shown in FIG. 3.

When the golfer hits golf ball 40, the person generally strikes the removable flexible tee 70 as well causing the upper photoelectric sensor 84 to send a signal to the logic center 101 which initiates the motor control 103 and causes motor 51 travel in the reverse direction it had previously traveled in raising the golf ball 40 to hitting position thus causing the removably flexible tee 70 to be lowered until the motor drive housing 55 contacts the lower position limit switch 86 which immediately causes motor 51 to stop.

Occasionally, a golfer will "pick" the golf ball 40 without touching the removable flexible tee 70 and it will be necessary for the golfer to manually actuate the golf swing practice device 10 by pushing the removable flexible tee 70 with his golf club, thus actuating the upper photoelectric sensor 84 and thus continuing the process as previously described.

While this invention has been illustrated and described in detail in connection with only certain embodiments thereof, it will be apparent that it is capable of still further modifications by one skilled in the art and that this application is intended to cover any such modifications.

What I claim:

1. A golf ball tee apparatus for automatically teeing golf balls enabling a golfer to practice hitting golf balls one at time including a supply of said golf balls, a means for teeing said golf balls, a delivery tube connected between said supply and said means for teeing said golf balls for providing a continuous supply of golf balls; said means for teeing said golf balls further including a tee; a drive means for automatically moving said tee between a lower ball engaging position in said receptacle to an upper ball hitting position wherein the improvement comprises:

said tee being a flexible tee allowing said golf balls to be hit from any direction without causing damage to said tee;

a first sensor means for detecting the presence and absence of a golf ball in said receptacle and a second sensor means for detecting the movement of said flexible tee in response to hitting a golf ball therefrom, whereby the flexible tee remains in the lower ball engaging position when the supply of said golf balls is exhausted.

2. The golf ball tee apparatus of claim 1 wherein said sensors are a pair of photoelectric detectors.

3. The golf ball tee apparatus of claim 1 wherein said receptacle is a cylindrical shaped cup and said first sensor means is located within an upper portion of the cup and said second sensor means is located within a lower portion of the cup.

4. The golf ball tee apparatus of claim 1 further including said drive means for moving said tee from the lower ball engaging position to the upper hitting position upon sensing of a golf ball in said receptacle by said first sensor means and retracting said tee from the upper hitting position to the lower ball engaging position in response to the movement of said flexible tee by said second sensor means.

5. The golf ball tee apparatus of claim 4 wherein said drive means includes a motor affixed to a motor drive train within a motor drive housing; a upper position switch and a lower position switch mounted adjacent to said motor drive housing so that in the lower position the motor drive is in contact with said lower position switch and when in the upper position said motor drive is in contact with said upper position switch disengaging power to said drive means.

6. The golf ball tee apparatus of claim 4 wherein said flexible tee protrudes through an opening in said receptacle to engage a ball in said receptacle.

7. The golf ball tee apparatus of claim 1 wherein said supply is a hopper connected to said ball delivery tube such that said ball delivery tube is fastened and inclined to said hopper allowing the golf balls to flow from said hopper through said tube to said receptacle by gravity.

8. The golf ball tee apparatus of claim 1 further including a ball receptacle restraint means for precluding a golf ball from entering said ball cup when said flexible tee is in its upper most position; said ball receptacle restraint means simultaneously guiding said means for teeing when moving upward and downward.

9. The golf ball tee apparatus of claim 1 wherein said flexible tee is removable.

* * * * *